US006439678B1

(12) United States Patent
Norton

(10) Patent No.: US 6,439,678 B1
(45) Date of Patent: Aug. 27, 2002

(54) METHOD AND APPARATUS FOR NON-SATURATED SWITCHING FOR FIRING ENERGY CONTROL IN AN INKJET PRINTER

(75) Inventor: Kirkpatrick William Norton, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/448,838

(22) Filed: Nov. 23, 1999

(51) Int. Cl.[7] ..... B41J 2/05
(52) U.S. Cl. ..... 347/9; 347/10
(58) Field of Search ..... 347/5, 9, 10, 17, 347/19, 57, 180, 191, 192, 198

(56) References Cited

U.S. PATENT DOCUMENTS

| | | | | |
|---|---|---|---|---|
| 4,396,923 A | 8/1983 | Noda | 347/191 |
| 4,404,567 A | 9/1983 | Katsuragi | 347/180 |
| 4,514,737 A | 4/1985 | Suzuki | 347/192 |
| 4,538,173 A | 8/1985 | Kirjavainen et al. | 358/75 |
| 4,739,346 A | 4/1988 | Buckley | 346/138 |
| 5,083,137 A | 1/1992 | Bady et al. | 347/14 |
| 5,132,709 A | 7/1992 | West | 346/76 |
| 5,187,500 A | 2/1993 | Bohorquez et al. | 347/57 |
| 5,526,027 A | 6/1996 | Wade et al. | 347/14 |
| 5,541,629 A | 7/1996 | Saunders et al. | 347/12 |
| 5,600,349 A | 2/1997 | Keefe | 347/11 |
| 5,682,185 A | 10/1997 | Wade et al. | 347/19 |
| 5,757,392 A | 5/1998 | Zhang | 347/14 |
| 5,767,872 A | 6/1998 | Scardovi et al. | 347/17 |
| 5,790,142 A | 8/1998 | Uchinami et al. | 347/15 |

FOREIGN PATENT DOCUMENTS

| | | | |
|---|---|---|---|
| EP | 0499373A 2 | 8/1992 | B41J/3/355 |

*Primary Examiner*—Anh T. N. Vo

(57) ABSTRACT

A method and apparatus for controlling firing energy in an inkjet printer are embodied in a control circuit and a regulated pen voltage source for an inkjet printer pen. The control circuit includes switches connected between the nozzle resistors of the pen and a low voltage rail. The control circuit is configured to control the voltages across the switches within a known tolerance, independent of variations in the switch current, integrated circuit process variations, temperature variations, and variations in the resistances of the nozzle resistors. The voltage provided to each nozzle resistor by the pen voltage source is adjusted to compensate for changes in the voltages across the switches.

15 Claims, 2 Drawing Sheets

METHOD AND APPARATUS FOR NON-SATURATED SWITCHING FOR FIRING ENERGY CONTROL IN AN INKJET PRINTER

BACKGROUND OF THE INVENTIONS

1. Field of Inventions

The present invention relates generally to a method and apparatus for controlling firing energy in a printer and, more specifically, to a method and apparatus for non-saturated switching for firing energy control in an inkjet printer.

2. Description of the Related Art

Thermal inkjet printers employ nozzle resistors to fire drops of ink. A sufficient amount of energy must be provided to each nozzle resistor to properly fire the drops of ink. If an amount of energy delivered to a nozzle resistor is too low, there may not be enough heat generated to eject an ink drop, or the velocity of the drop may be too low. Either condition may result in visible defects in the printed page. If the amount of energy delivered to a nozzle resistor is too high, the resistor may get too hot resulting in decreased pen life. For these reasons, accurate energy control is essential for proper operation of thermal inkjet pens.

Referring to FIG. 1, a control electronics/ inkjet pen system 100 of an inkjet printer includes a main electronics board 102, an inkjet pen 104, an interconnecting cable 106 and associated connectors 108, 110 at each end of the cable 106. An exemplary preferred electronics board 102 includes a voltage regulator circuit 112 for creating an accurate pen voltage and a pen driver integrated circuit (IC) 114 containing solid state switches for turning nozzle currents on and off.

When the driver switches are turned on, electrical current flows from the pen voltage supply at board 102, through the cable 109, through the nozzle resistors in the pen 104, and returns back through the cable 106 to the ground side of the pen voltage supply. Since none of these components are ideal, there are losses associated with each of them. For instance, switches of the pen driver IC 114 have some resistance that creates a voltage drop when current flows through them. Likewise, the cable 106 and connectors 108, 110 have resistances of their own resulting in further losses. Since these resistances are not exactly known and vary from printer to printer and over temperature, the amount of current flowing through the nozzle resistors is difficult to perfectly control. Other contributors to energy errors stem from the tolerance of the generated pen supply voltage and variations in the resistances of the nozzle resistors themselves.

FIG. 2 shows an electrical schematic representation of the system of FIG. 1 including non-ideal parameters which contribute to errors in delivered energy. In this schematic, $V_{Supply}$ represents the voltage of the pen voltage supply, $R_{Series}$ represents the series combination of the cable and connector resistances, $T_{Fire}$ is the time for which the switch is closed, and $V_{Switch}$ is the voltage drop across the switch when current is flowing while the switch is closed. Energy variations due to the loss across the switch contribute significantly to the energy error and, for the electrical schematic of FIG. 2, are calculated as follows:

$$E_{Fire} = \left(\frac{V_{supply} - V_{switch}}{R_{Series} + R_{Pen}}\right)^2 \times R_{Pen} \times T_{Fire}$$

In this equation, the current flowing through $R_{Pen}$ is given by the term in parentheses, which is equivalent to the voltage across both resistances divided by the sum of the resistances. Since the energy is proportional to the square of the current, the energy will change at approximately twice the rate the current changes. In other words, if the current is allowed to vary by ±1%, the energy will vary by ±2%. If the current varies by ±5%, the energy will vary by ±10%, etc. This is a result of the fact that a change in something is equivalent to its derivative, and the derivative of $x^2$ (with respect to x) is 2.

Since the term inside the parentheses is equal to current, the current is proportional to the quantity $(V_{Supply}-V_{Switch})$ As this quantity changes, the energy delivered to the pen changes at twice the rate. Assuming the supply voltage is known exactly, it is possible to determine how variations in the switch voltage affect the delivered energy. Since the supply voltage is greater than the switch voltage, a variation in the switch voltage will result in a smaller variation in the overall quantity $(V_{Supply}-V_{Switch})$. Thus, variation in current is determined by the following equation.

$$\text{Variation in current} = \Delta I = \Delta(V_{Supply}-V_{Switch}) = \Delta V_{Switch} * (V_{Switch}/V_{Supply}-V_{Switch})) \quad \text{Eq. 1}$$

where "Δ" indicates a percent variation in the corresponding value. For instance, if $V_{Supply}$ is five times greater than $V_{Switch}$, $V_{Switch}/(V_{Supply}-V_{Switch})$ would be 0.25, and variations in $V_{Switch}$ would result in one fourth the variation in current. By way of example, where $V_{Supply}$ is 12.0 volts and $V_{Switch}$ is 1.3 volts ±30%:

$$\text{Variation in current} = \Delta I = 30\% * (1.3/(12.0-1.3)) = 3.6\%.$$

Recall that variation (or tolerance) in the energy delivered to the pen is twice the variation in current since energy is proportional to the current squared. Therefore, the energy tolerance due to the switch voltage tolerance is doubled to 7.2%. By itself, this is already in violation of the specified limits for some inkjet pens. An understanding of each of the parameters in the electrical schematic of FIG. 2 would be useful to the end of tightening all of the tolerances as much as possible. With respect to the switches in the pen driver IC 114 (FIG. 1), it would be useful to be able to accurately characterize the voltage drop across the switches for improving the accuracy in delivered energy.

Past architectures have attempted to solve this problem by making the switch voltage drop as small as possible. In practice, these switches are transistors (field-effect or bipolar) that are designed to have very low resistance and voltage when they are turned on. By making this voltage very small, the overall error contributed by the switch voltage drop is less (see Equation 1). However, implementing such very low on-resistance transistors in an integrated circuit requires that the transistors occupy a relatively large area of the silicon die. When many of these transistors are contained on the same die (which is usually the case with typical pen driver ICs), the area of the die can become fairly large, resulting in increased cost for the IC. For instance, to reduce the on-resistance between the drain and source ($R_{DSon}$) of a field effect transistor, many small transistors are connected in parallel to form a compound transistor such that the overall channel resistance reduction is proportional to the number of individual transistors used. The $R_{DSon}$ of these transistors in typical pen drivers is kept small enough that, when current passes through the switch, the voltage drop is small enough to yield an acceptable variation in energy. Notwithstanding, there remains a need for a method and apparatus for firing energy control in a printer that maintains an acceptable tolerance for the voltage drop across the driver transistors to precisely control the amount of energy provided to the nozzle resistors while keeping the size of the driver transistors relatively small.

SUMMARY OF THE INVENTION

According to the present invention, a method and apparatus for controlling firing energy in an inkjet printer reduces energy errors induced by the voltage drop across the switch by first accurately characterizing this voltage drop. Since the voltage drop across the switch is well characterized, the pen voltage can be increased to compensate for this loss (i.e. ($V_{Supply}$–$V_{Switch}$) is kept constant by increasing the supply voltage by an amount equal to the switch voltage drop). The firing energy control implementation of the present invention keeps the voltage across the pen and current well characterized; and the energy delivered to the pen is therefore controlled more accurately. Additionally, the firing energy control implementation of the present invention facilitates the employment of a driver IC with smaller driver transistors which results in space and cost savings in the driver IC.

The present invention exploits the fact that, for accurate energy control, the voltage drop needs to be well characterized, but does not necessarily need to be small. Even if the voltage drop across the switch is large, if the tolerance of the voltage drop is tight, the contributed energy fluctuations may still be kept small by employing the pen voltage supply to compensate for this known voltage drop across the switch. In an exemplary preferred embodiment, this is accomplished by operating the switching transistors just outside the saturation region and using a voltage monitor to control the switch voltage drop.

A method for controlling firing energy in an inkjet printer in accordance with one embodiment of the present invention includes the steps of: controlling a voltage across a low side driver which is electrically connected to a nozzle resistor of an inkjet printer pen; and adjusting a pen supply voltage which is electrically connected to the pen to compensate for changes in the voltage across the low side driver.

A method for controlling firing energy in an inkjet printer in accordance with another embodiment of the present invention includes the steps of: controlling a switch voltage across a switch which is electrically connected to a nozzle resistor of a printer pen; and adjusting a pen supply voltage which is electrically connected across the pen and the nozzle resistor to compensate for changes in the switch voltage.

An apparatus for controlling firing energy in an inkjet printer in accordance with another embodiment of the present invention includes: an inkjet pen including a nozzle resistor; a control circuit including a switch electrically connected between the nozzle resistor and a low voltage rail, the control circuit being configured to control a switch voltage across the switch; and a regulated pen voltage source which provides a pen voltage to the nozzle resistor, the pen voltage being adjusted to compensate for the voltage drop across the switch.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the inventions will be made with reference to the accompanying drawings.

DETAILED DESCRIPTION OF THE PREFERRED EMBODIMENTS

The following is a detailed description of the best presently known mode of carrying out the invention. This description is not to be taken in a limiting sense, but is made merely for the purpose of illustrating the general principles of the invention.

Figure 1:
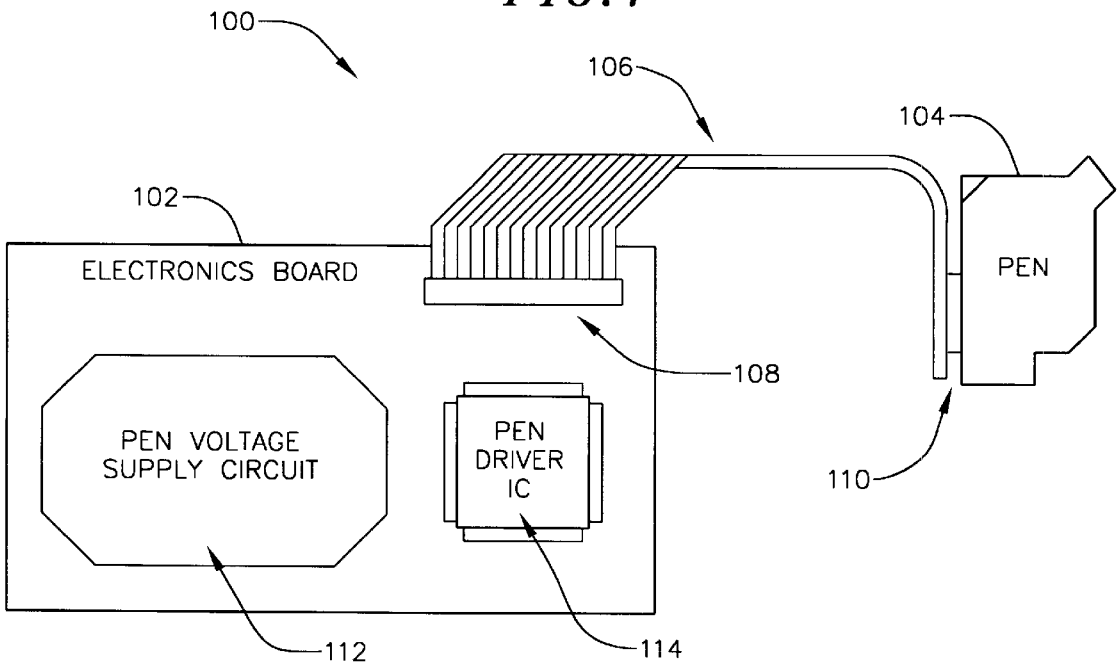
FIG. 1 shows a control electronics/ inkjet pen system suitable for employing the method and apparatus for controlling firing energy in a printer according to the present inventions
Figure 2:
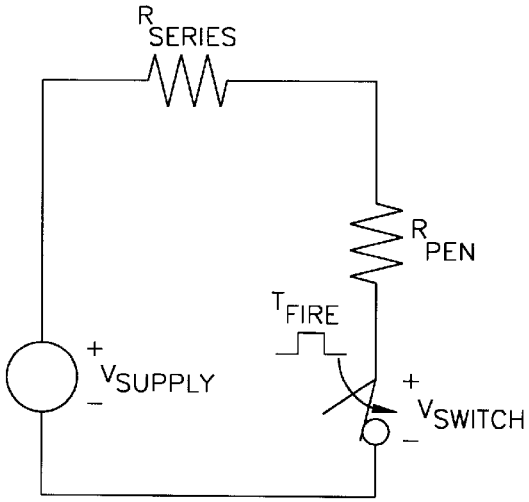
FIG. 2 is an electrical schematic representation of the system of FIG. 1 including non-ideal parameters which contribute to errors in energy delivered to the pen.
Figure 3:
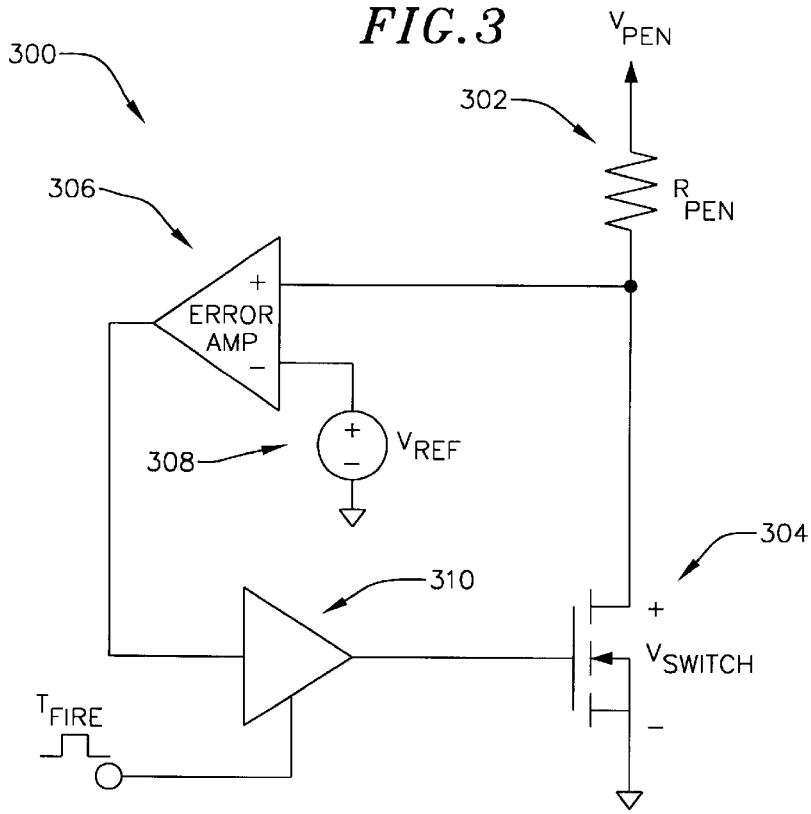
FIG. 3 is an electrical schematic of an exemplary preferred nozzle resistor firing control circuit according to the present invention.

Referring to FIG. 3, an exemplary preferred firing control circuit 300 according to the present invention includes a nozzle resistor 302, a switch 304, an error amplifier 306, a reference voltage source 308 and a buffer 310 configured as shown. An exemplary preferred switch 304 comprises a low side driver such as a metal-oxide-semiconductor field-effect-transistor (MOSFET), junction field-effect-transistor (JFET), bipolar transistor, or any semiconductor (or other) switch. Low side drivers are preferred for the switch 304; however, high side drivers with a controlled voltage across them can also be employed.

When the firing pulse (designated by $T_{Fire}$) arrives, the buffer 310 driving the gate of the switching FET 304 3 is enabled and the FET 304 is switched on. As the FET 304 turns on, current begins to flow through the nozzle resistor ($R_{pen}$) 302, and the switch voltage ($V_{Switch}$) begins to drop. As this voltage reaches the reference voltage ($V_{Ref}$), the output of the error amplifier 306 is reduced; thus, the FET 304 begins to turn off (its channel resistance increases). When $V_{Switch}$ gets very close to $V_{Ref}$, the FET 304 is turned on just enough to sink enough current to keep these two voltages very close together. $V_{Switch}$ is controlled not to drop below $V_{Ref}$ because the FET 304 does not allow that much current to flow. Preferably, the FET 304 is never fully turned on and therefore never operates in the saturation region. Consequently, the FET 304 does not need to have a low or tightly controlled $R_{DSon}$; the feedback circuit keeps the voltage drop at a very tight tolerance.

Although the FET 304 dissipates more power since it is not saturated, this is not problematic for many pen driver ICs since the number of nozzles driven simultaneously is often low enough that the package of the IC can tolerate the excess heat. The $R_{DSon}$ of the switching FET 304 varies from IC to IC due to variations in manufacturing conditions and materials. In an exemplary preferred embodiment, the firing control circuit 300 is designed such that the worst case IC (i.e. the one with the highest possible $R_{DSon}$ will just begin to saturate under worst case operating conditions. This allows the $R_{DSon}$ to be as high as possible and still be able to drive the switch voltage down to the target voltage. If the $R_{DSon}$ is as high as possible, the FET 304 occupies as little silicon area as possible, so the IC cost is kept low.

An advantage of this firing energy control implementation is that the $R_{DSon}$ can be higher than if no feedback control is used. For instance, if the voltage drop is set at 1.5 volts and the pen current is 250 mA per nozzle driver, the $R_{DSon}$ can be as high as 6.0 Ω as long as the voltage is controlled well enough and thermal dissipation is not a problem. A voltage tolerance of as little as ±10% (±0.15 volt in this case) is typically achievable. If the pen supply voltage is 12.0 volts, the resulting current variation is ±1.4% (refer to Eq. ), so the energy error caused by the voltage variation in this scenario would be doubled to 2.8%. To achieve the same tight energy tolerance with an open-loop FET switch (i.e. no feedback control), the FET would require a maximum variation in $R_{DSon}$ of around ±0.6 Ω. Typically, a switching FET in this application will have a variation of about 2-to 1 over process and temperature, so the maximum $R_{DSon}$ of an open-loop FET would have to be about 1.2 Ω. This requires five times the area on the silicon die as the 6 Ωresistor in the closed-loop, non-saturated system. Even though the approach of the present invention employs extra circuitry to perform the voltage monitoring and control, this control circuitry is very small in size compared to the high current switching transistors.

It should be understood that the principals of the present invention are not limited to the foregoing nozzle resistor firing energy control implementation. For example, instead of controlling the voltage drop across the switch, the value of $R_{DSon}$ itself can be monitored. By monitoring the voltage drop and current simultaneously, the resistance of the FET 304 can be determined, and the gate (control) voltage adjusted to keep this resistance constant. Either way, feedback is employed to keep the FET 104 operating in a non-saturated mode at the modest expense of generating some excess heat.

Figure 4:
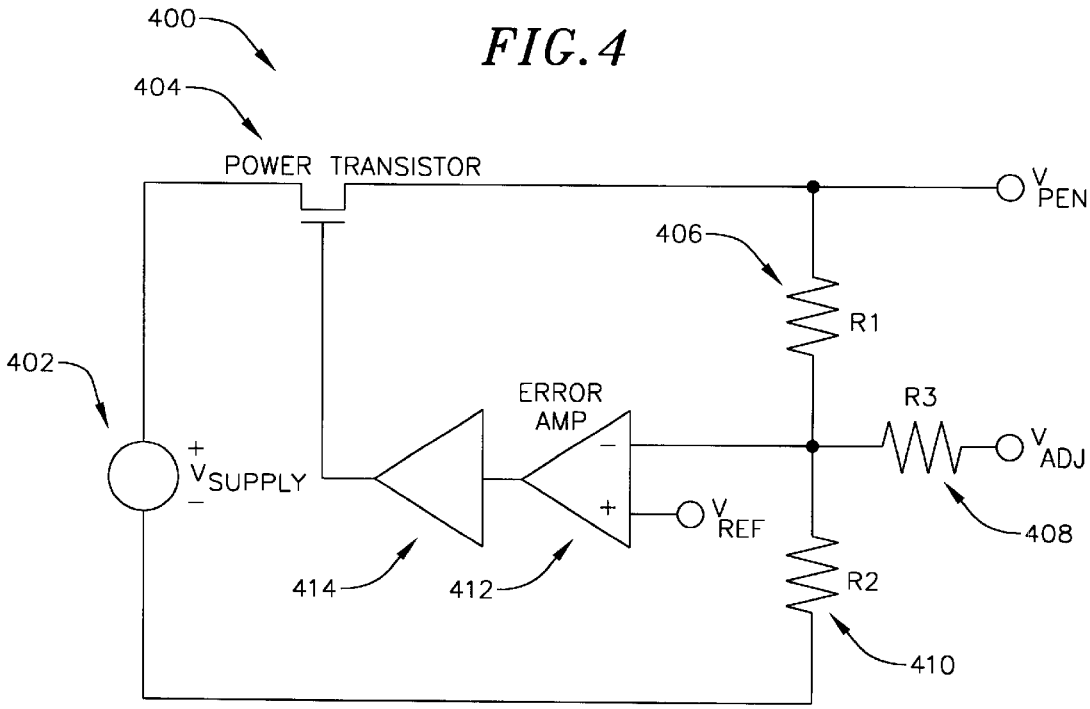
FIG. 4 is an electrical schematic of an exemplary preferred voltage regulator circuit according to the present invention.

FIG. 4 shows an exemplary preferred linear voltage regulator circuit 400 for an inkjet printer system. The voltage regulator circuit 400 provides an accurate supply voltage ($V_{PEN}$) for driving the nozzle resistors of the pens and includes an unregulated power supply 402, a power transistor 404, resistors 406, 408, 410, an error amplifier 412 and a buffer 414 configured as shown. The following equation shows how $V_{PEN}$ is generated by the voltage regulator circuit 400:

$$V_{PEN}=(V_{REF}\times(R1-R2)/R2)+((R1/R3)\times(V_{REF}-V_{ADJ})).$$

The supply voltage $V_{SUPPLY}$ is regulated, for example, to within one or two volts. This is not accurate enough to directly drive the pens since tight energy control is required, and the voltage needs to be adjustable to accommodate nozzle resistors with resistance values that change from pen to pen. The regulator circuit 400 regulates the supply voltage $V_{SUPPLY}$ to a programmable pen driving voltage $V_{PEN}$ by setting an adjustment voltage $V_{ADJ}$ to compensate for changes in the switch voltage $V_{SWITCH}$ (FIG. 3).

The pen driving voltage $V_{PEN}$ is used to directly drive all nozzle resistors on a pen. Individual nozzle resistors are selectively fired using the low side driver transistors. A typical inkjet pen may have a nozzle resistor process variation of 30% or more resulting in driving current changes from pen to pen. According to the present invention, the voltage drop across the driver transistors is controlled such that each driver (when turned on to fire the pen) has a "preset voltage", e.g., 1.5 volts, across it that is known within a required precision. However, over the range of possible current variation for the drivers, some variation in the voltage across the drivers will occur, but since the driver voltage is small relative to the voltage across the pen, some small variation is acceptable. By employing the feedback controller 300 of FIG. 3 to stabilize the driver voltage, the voltage can be controlled to within better than 10% percent even though the current varies by much more.

The "on-voltage" across the switches 304 (when they are on) must be selected carefully. If the voltage is too low, the low side driver transistors must be very large (i.e. require a large area of silicon) in order to have a sufficiently low on resistance to achieve the low voltage while driving the high currents required by typical inkjet pens. If the voltage is set too high, the transistors heat up while driving the nozzle resistors due to excessive power dissipation since the current through the transistor is large as is the voltage across it (power=voltage*current). In either case (voltage too high or too low), the cost of the pen driver IC increases substantially. In the first case, the silicon die must be larger to accommodate the larger transistors required to achieve low on resistance. In the second case, a more expensive IC package would be required to dissipate excess heat generated by the large voltage drop while the nozzle resistor current is flowing.

Preferably, the on voltage is sufficiently low to set the power dissipation just within the acceptable limits of an inexpensive IC package, yet sufficiently high to allow the drive transistors to have larger (yet acceptable) on resistances, yielding less silicon area required per transistor. An acceptable range of on voltages varies depending upon the silicon process of the IC and other system parameters.

Although the present invention has been described in terms of the preferred embodiments above, numerous modifications and/or additions to the above-described preferred embodiments would be readily apparent to one skilled in the art. It is intended that the scope of the present invention extend to all such modifications and/or additions.

I claim:

1. A method for controlling firing energy in an inkjet printer with a printer pen, the method comprising the steps of:

controlling a switch voltage across a switch which is electrically connected to a first side of a nozzle resistor of the printer pen, and adjusting a pen supply voltage which is electrically connected to a second side of the nozzle resistor to compensate for changes in the switch voltage;

wherein the switch voltage is controlled such that the switch operates in a non-saturated mode.

2. A method for controlling firing energy in an inkjet printer as claimed in claim 1, wherein a feedback loop electrically connected from the first side of the nozzle resistor to a gate of the switch is employed to control the switch voltage.

3. A method for controlling firing energy in an inkjet printer as claimed in claim 1, wherein the switch voltage is controlled from decreasing below a reference voltage selected such that the switch will retain an ON resistance sufficiently low for the switch to drive an amount of current through the nozzle resistor that is sufficiently large to fire the pen.

4. A method for controlling firing energy in an inkjet printer as claimed in claim 1, wherein the switch is a low side driver.

5. An apparatus for controlling firing energy in an inkjet printer with an inkjet pen including a nozzle resistor, the apparatus comprising:

a control circuit including a switch electrically connected between a first side of the nozzle resistor and a low voltage rail, the control circuit being configured to control a switch voltage across the switch; and a regulated pen voltage source which provides a pen voltage to a second side of the nozzle resistor, the pen voltage being adjusted to compensate for changes in the switch voltage;

wherein the control circuit is configured to control the switch voltage such that the switch operates in a non-saturated mode.

6. An apparatus for controlling firing energy in an inkjet printer as claimed in claim 5, wherein the control circuit is an integrated circuit.

7. An apparatus for controlling firing energy in an inkjet printer as claimed in claim 5, wherein the control circuit includes a feedback loop electrically connected from the first side of the nozzle resistor to a gate of the switch.

8. An apparatus for controlling firing energy in an inkjet printer as claimed in claim 5, wherein the control circuit is configured to receive a nozzle firing pulse.

9. An apparatus for controlling firing energy in an inkjet printer as claimed in claim 5, wherein the control circuit is configured to control the switch voltage from drifting past a reference voltage such that the switch will retain an ON resistance sufficiently low to drive an amount of current through the nozzle resistor which is sufficiently large to fire the pen.

10. An apparatus for controlling firing energy in an inkjet printer as claimed in claim 9, wherein the control circuit is an integrated circuit.

11. An apparatus for controlling firing energy in an inkjet printer as claimed in claim 9, wherein the reference voltage is set sufficiently low to prevent an amount of power dissipation by the switch in excess of a predetermined amount.

12. An apparatus for controlling firing energy in an inkjet printer as claimed in claim 5, wherein the switch is a transistor.

13. An apparatus for controlling firing energy in an inkjet printer as claimed in claim 5, wherein the switch is a low side driver transistor.

14. An apparatus for controlling firing energy in an inkjet printer as claimed in claim 5, wherein the switch is a field-effect-transistor (FET).

15. An apparatus for controlling firing energy in an inkjet printer as claimed in claim 5, wherein the switch is a metal-oxide-semiconductor field-effect-transistor (MOSFET).

* * * * *